US008294383B2

(12) United States Patent
Scollo et al.

(10) Patent No.: US 8,294,383 B2
(45) Date of Patent: Oct. 23, 2012

(54) ELECTRONIC DRIVING DEVICE FOR LAMPS, IN PARTICULAR HID LAMPS

(75) Inventors: Rosario Scollo, Misterbianco (IT); Giuseppe Catalisano, Palermo (IT)

(73) Assignee: STMicroelectronics S.r.l., Agrate Brianza (IT)

( * ) Notice: Subject to any disclaimer, the term of this patent is extended or adjusted under 35 U.S.C. 154(b) by 551 days.

(21) Appl. No.: 12/547,017

(22) Filed: Aug. 25, 2009

(65) Prior Publication Data

US 2010/0052559 A1 Mar. 4, 2010

(30) Foreign Application Priority Data

Sep. 2, 2008 (IT) ..... MI2008A1566

(51) Int. Cl.
*H05B 41/16* (2006.01)

(52) U.S. Cl. ..... 315/276; 315/291; 315/326

(58) Field of Classification Search ..... 315/246, 315/268, 276, 279, 291, 307, 326, 349–352
See application file for complete search history.

(56) References Cited

U.S. PATENT DOCUMENTS

| | | | | |
|---|---|---|---|---|
| 4,356,433 | A | 10/1982 | Linden | |
| 5,500,792 | A * | 3/1996 | Jeon et al. | 363/98 |
| 6,351,074 | B1 | 2/2002 | Ito et al. | |
| 6,563,275 | B2 * | 5/2003 | Ito et al. | 315/308 |
| 2002/0047644 | A1 * | 4/2002 | Ito et al. | 315/308 |
| 2005/0110431 | A1 * | 5/2005 | Ben-Yaakov | 315/291 |
| 2006/0087250 | A1 | 4/2006 | Fiorello | |

FOREIGN PATENT DOCUMENTS

WO 03065556 A2 8/2003

* cited by examiner

*Primary Examiner* — Jason M Crawford
(74) *Attorney, Agent, or Firm* — Seed IP Law Group PLLC

(57) ABSTRACT

A driving device for a lamp, in particular an HID lamp, the device including a first circuit to convert a network input voltage into a output direct voltage, a second circuit that receives the direct voltage as an input and converts the direct voltage into an alternating signal for supplying the lamp. The first circuit includes a transformer provided with a secondary winding elements a center tap. The driving device further includes at least two capacitive elements connected to the center tap of the secondary winding of the transformer and coupled with the ends of the secondary winding and with the input of the second circuit.

15 Claims, 5 Drawing Sheets

ELECTRONIC DRIVING DEVICE FOR LAMPS, IN PARTICULAR HID LAMPS

BACKGROUND

1. Technical Field

The present disclosure relates to a device for driving lamps, in particular HID lamps.

2. Description of the Related Art

There are known electronic devices suitable for driving lamps, in particular HID lamps. These particular lamps have a gas within the bulb, for example metal halide or mercury vapor; the lamps require a voltage even higher than 20 KV in order to be ignited for a period of a few seconds and a voltage between 80 V and 110 V in order to be maintained turned on. HID lamps work at a low frequency, from 150 to 800 Hz, in order to avoid damage due to acoustic resonance.

The device normally used to drive HID lamps is the ballast. Ballasts are formed with circuit topologies that make use of microcontrollers and rather complex configurations of power transistors. Typically, four power switches in a bridge configuration are provided, two of which work at a high frequency (80-100 KHz) to regulate the current across the lamp, whereas the other two work at a low frequency (150-400 Hz) to meet requirements of a mechanical nature of the lamp itself.

Therefore, an HID lamp requires a very particular and precise control that renders the circuit design rather complex.

BRIEF SUMMARY

In view of the present state of the art, the present disclosure provides a driving device for lamps, in particular HID lamps, that is different from prior devices. The driving device has a simpler circuit configuration while maintaining the same good quality of operation as the known devices.

According to one embodiment of the present disclosure, a device for driving a lamp, an HID lamp in particular, is provided, the device having a first circuit adapted to convert an input network voltage into an output direct voltage, a second circuit having at the input said direct voltage and adapted to convert the direct voltage to an alternated signal to supply the lamp. Ideally, the first circuit includes a transformer that has a secondary winding with a center tap. The device has at least two capacitive elements connected to the center tap of the secondary winding of the transformer and coupled with the ends of said secondary winding and with the input of the second circuit.

In accordance with another embodiment of the present disclosure, a circuit is provided that includes a first converter circuit having an input to receive an input voltage and generating on an output a filtered and rectified voltage; a second converter circuit coupled to the first converter circuit to receive the filtered and rectified voltage and to output an alternating voltage, the second converter circuit comprising a transformer having a secondary winding with a center tap on which is output an alternating signal that is received at a half-bridge circuit, and the second converter circuit further comprising a first capacitance and a second capacitance coupled respectively to first and second terminals of the secondary winding and to first and second terminals of the half-bridge circuit, the half-bridge circuit generating a driving current with an alternating square-wave voltage.

In accordance with another aspect of the foregoing embodiment, the circuit includes a control circuit coupled to the secondary winding and adapted to detect and sum together a detected voltage and a detected current of the alternating signal on the center tap of the secondary winding as a sum signal and to maintain the sum signal constant.

In accordance with another aspect of the foregoing embodiment, the circuit includes a controller device coupled to the control circuit and adapted to compare the sum signal to a constant reference signal and to generate an error signal that is used to drive the first converter circuit.

In accordance with another aspect of the foregoing embodiment, the circuit includes a circuit for recovering leakage energy on an inductance of the transformer, the leakage energy recovery circuit comprising a capacitor and two diodes coupled to a primary winding of the transformer to obtain a re-flux of the leakage current in the primary winding of the transformer when a transistor of the first converter circuit is turned off.

In accordance with another aspect of the foregoing embodiment, the circuit includes a protection circuit having a capacitor coupled to receive the filtered and rectified voltage and connected with a Zener diode so that when the filtered and rectified voltage across the capacitor of the protection circuit overcomes a threshold voltage of the Zener diode, the protection circuit sends a signal for turning off the driving current with an alternating square-wave voltage.

In accordance with another aspect of the foregoing embodiment, the circuit includes an HID lamp that is coupled to the half-bridge circuit and is driven by the driving current with an alternating square-wave voltage.

BRIEF DESCRIPTION OF THE SEVERAL VIEWS OF THE DRAWINGS

The characteristics and advantages of the present disclosure will become apparent from the following detailed description of an embodiment thereof, illustrated solely by way of non-restrictive example in the appended drawings, in which.

DETAILED DESCRIPTION

Figure 1:
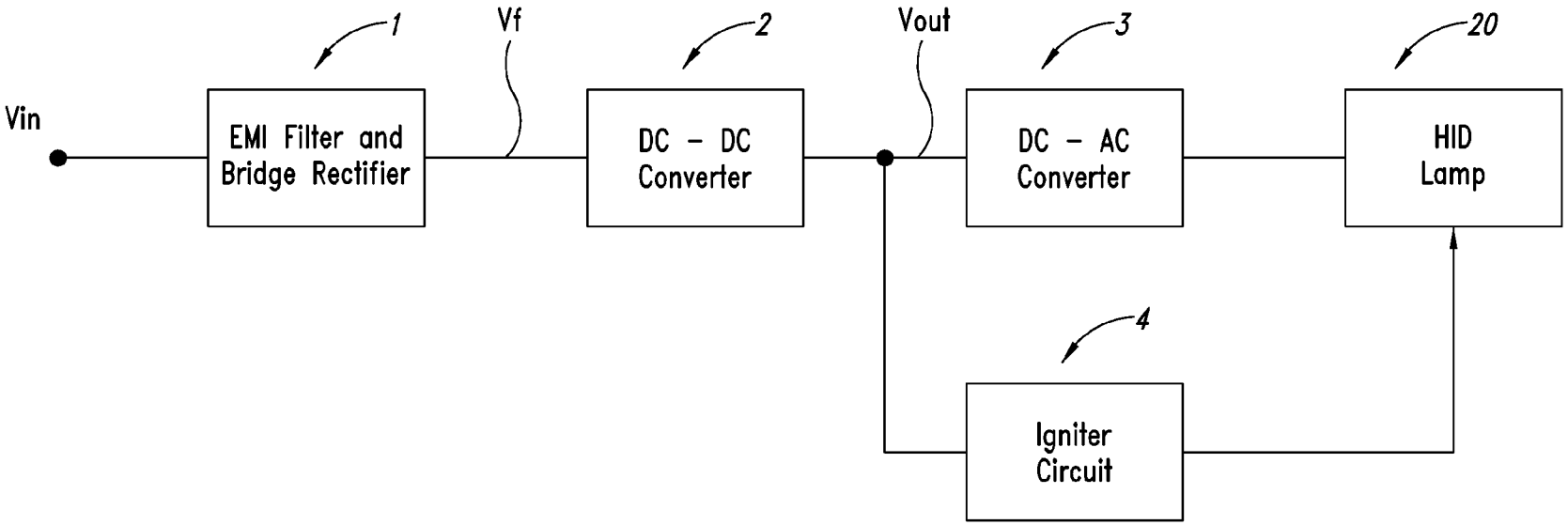
FIG. 1 is a block diagram of a device for driving HID lamps according to the present disclosure.

With reference to FIG. 1, there is shown a block diagram of the device for driving a lamp, in particular an HID lamp, according to the present disclosure. The driving device or ballast includes a block 1 having an EMI filter and a bridge rectifier of the network input voltage Vin, a stage 2 having a DC-DC converter and a control device and, preferably, a PFC circuit with a boost converter, a DC-AC converter 3 that supplies the HID lamp 20 and an igniter circuit 4.

Figure 2:
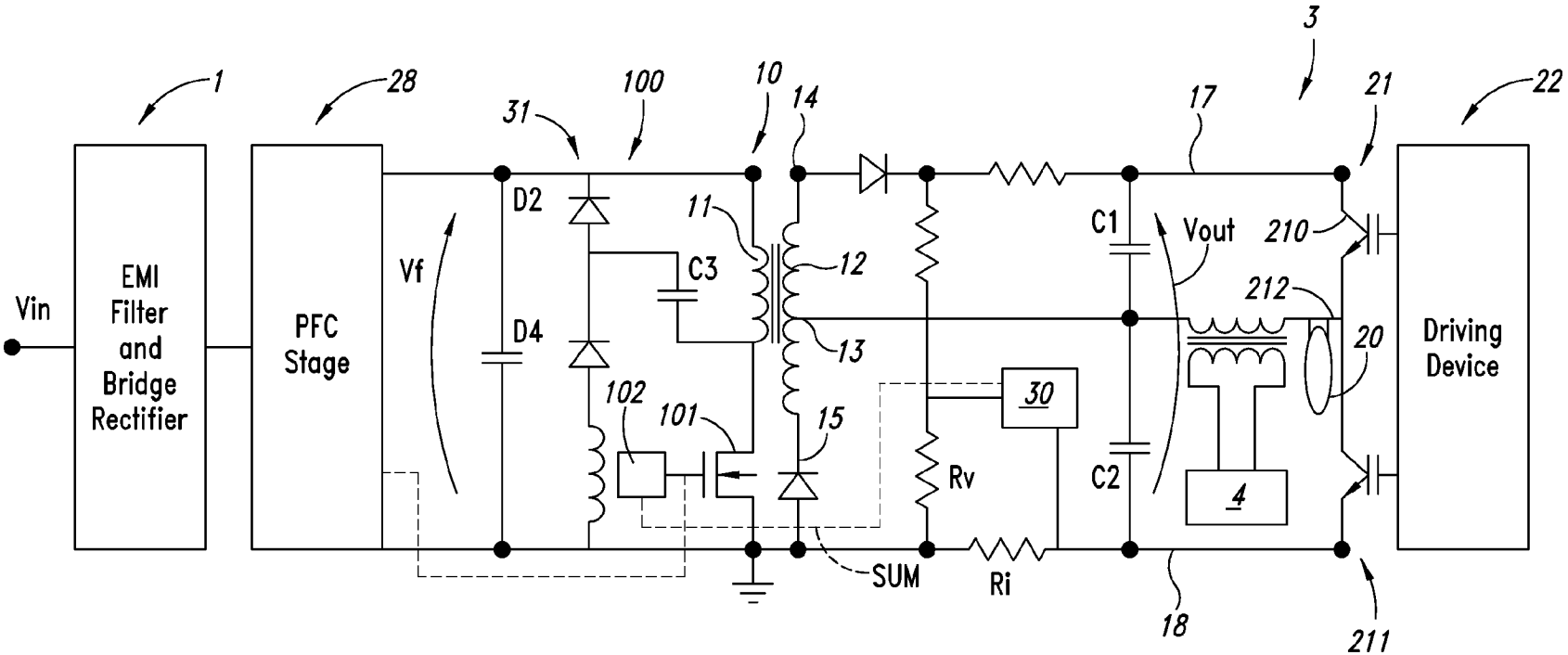
FIG. 2 is a simplified circuit diagram of a part of the device for driving HID lamps according to the present disclosure.
Figure 3:
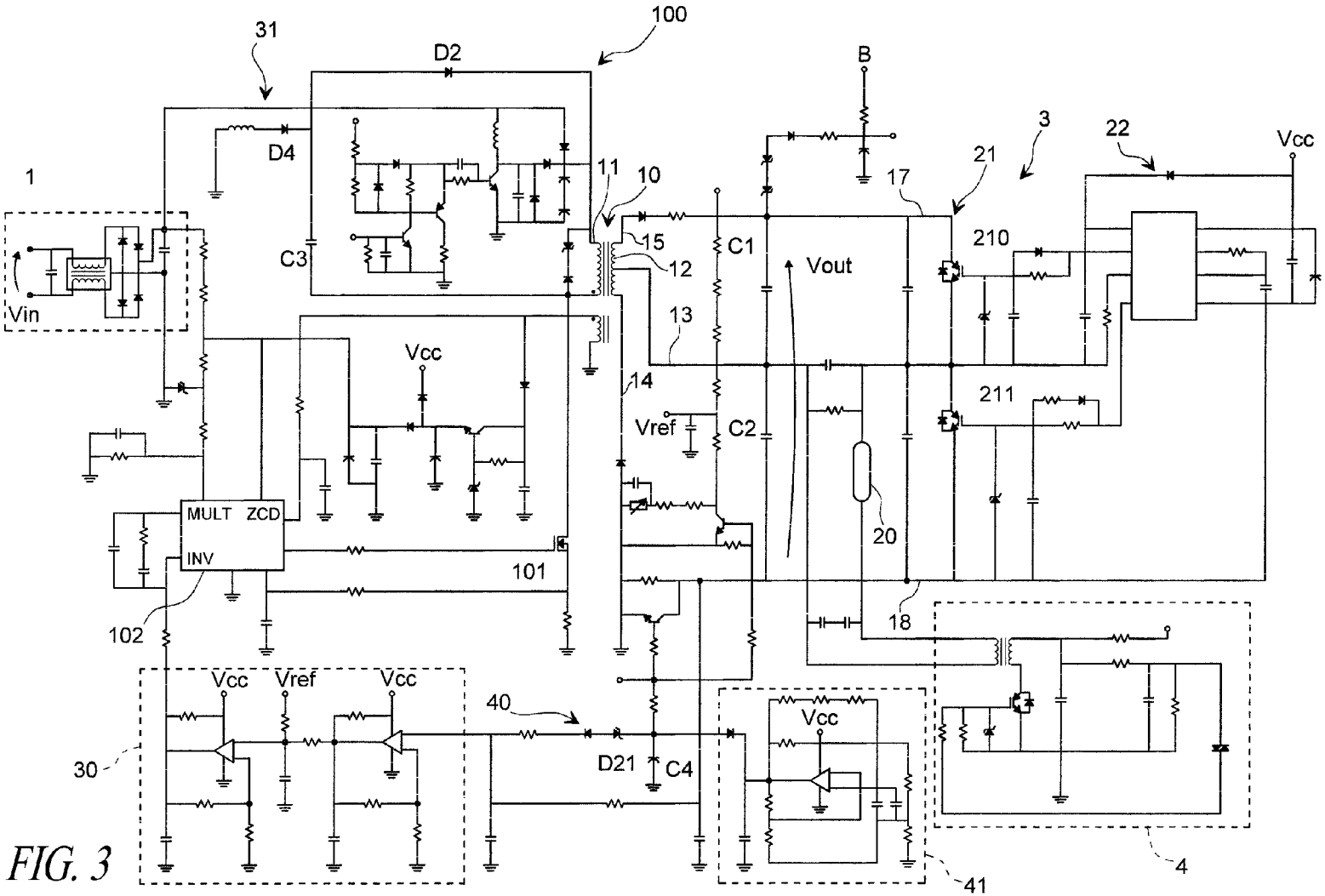
FIG. 3 is a circuit diagram of the device of FIG. 1.

As may be better seen in FIGS. 2 and 3, the DC-AC converter 3 is provided with a transistor half-bridge 21, preferably an IGBT half-bridge, with an associated driving device 22.

The block 1 is of a known type whereas the block 2 has a flyback-type DC-DC converter 100 provided with a transformer 10 having a primary winding 11 and a secondary winding 12; the secondary winding is of the center-tapped type. Preferably, the input voltage Vf to the flyback converter 100 is supplied by a PFC stage 28 receiving as input the voltage Vin filtered and rectified by the block 1; this in order to assure a very stable input voltage for the flyback converter 100.

The secondary winding 12 of the transformer 10 has the center tap 13 connected to a first capacitance C1 and a second capacitance C2 coupled respectively to the terminals 14 and 15 of the secondary winding 12 and connected to the input terminals 17 and 18 of the transistor half-bridge 21; also the HID lamp 20 and the central terminal 212 of the IGBT half-bridge 21 are coupled to the center tap 13 of the secondary winding 12. The IGBT half-bridge 21 receives the voltage Vout deriving from the secondary winding as input and supplies the HID lamp 20 with a current having constant modulation and amplitude whose ripple is minimized by the capacitance C1 and C2. Said capacitances are not of the electrolytic type, but have a low value, on the order of a few hundred nanofarads; in this manner it is possible to drive the HID lamp at around 200 Hz without the use of electrolytic capacitances, which would preclude obtaining control of the lamp current. The use of the low value capacitances C1 and C2 is possible due to the center tap of the secondary winding of the transformer, which enables the closing of the circuit for charging and discharging the capacitances irrespective of whether the two IGBT transistors of the half-bridge 21 are turned off or on. The IGBT half-bridge 21 supplies a square wave voltage to the HID lamp 20 and is suitably driven by a device 22. The half-bridge has two IGBTs 210, 211.

Figure 4:
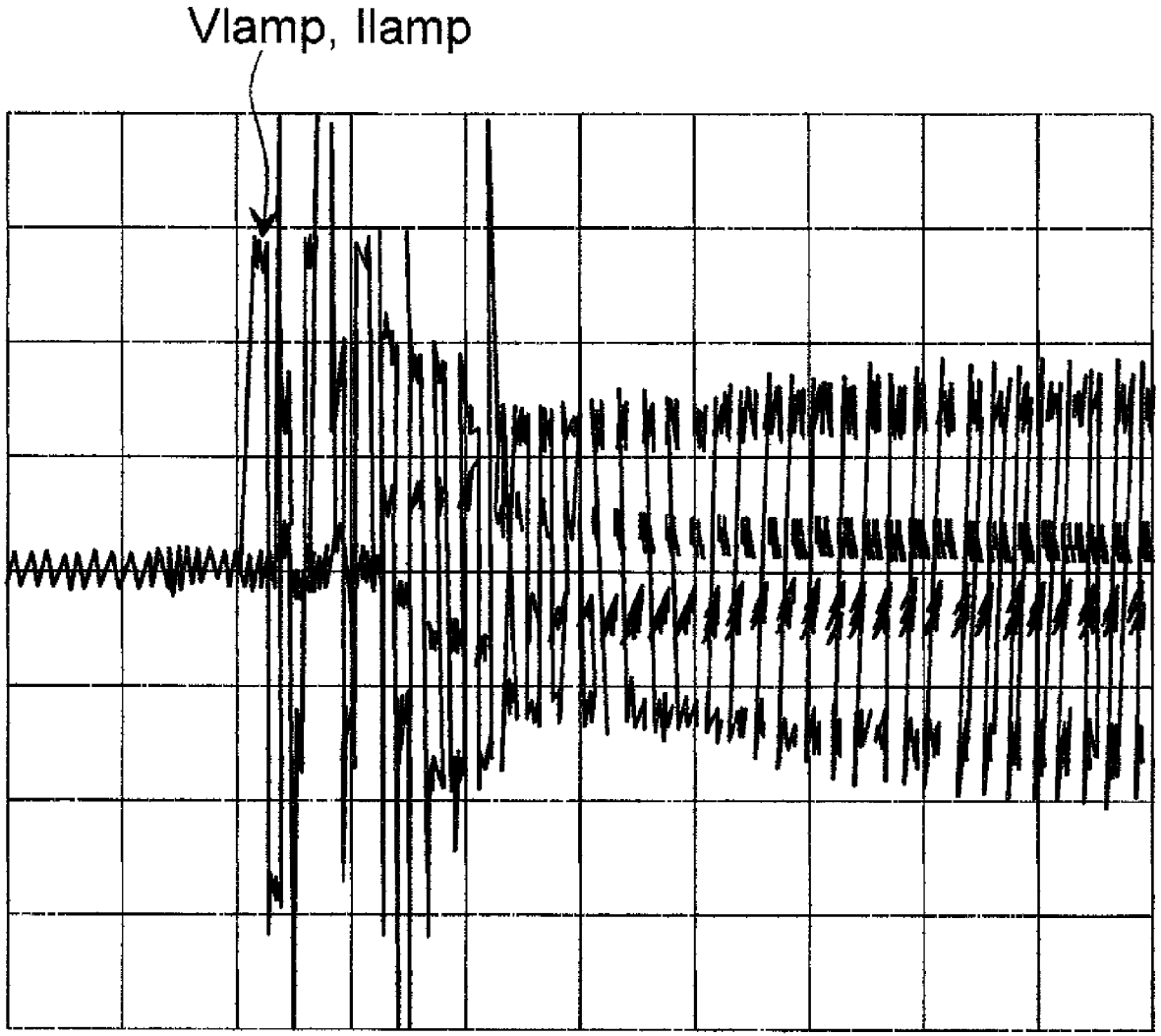
FIGS. 4 and 5 are time diagrams of the voltage and current across the lamp respectively during striking and after striking of the lamp.
Figure 5:
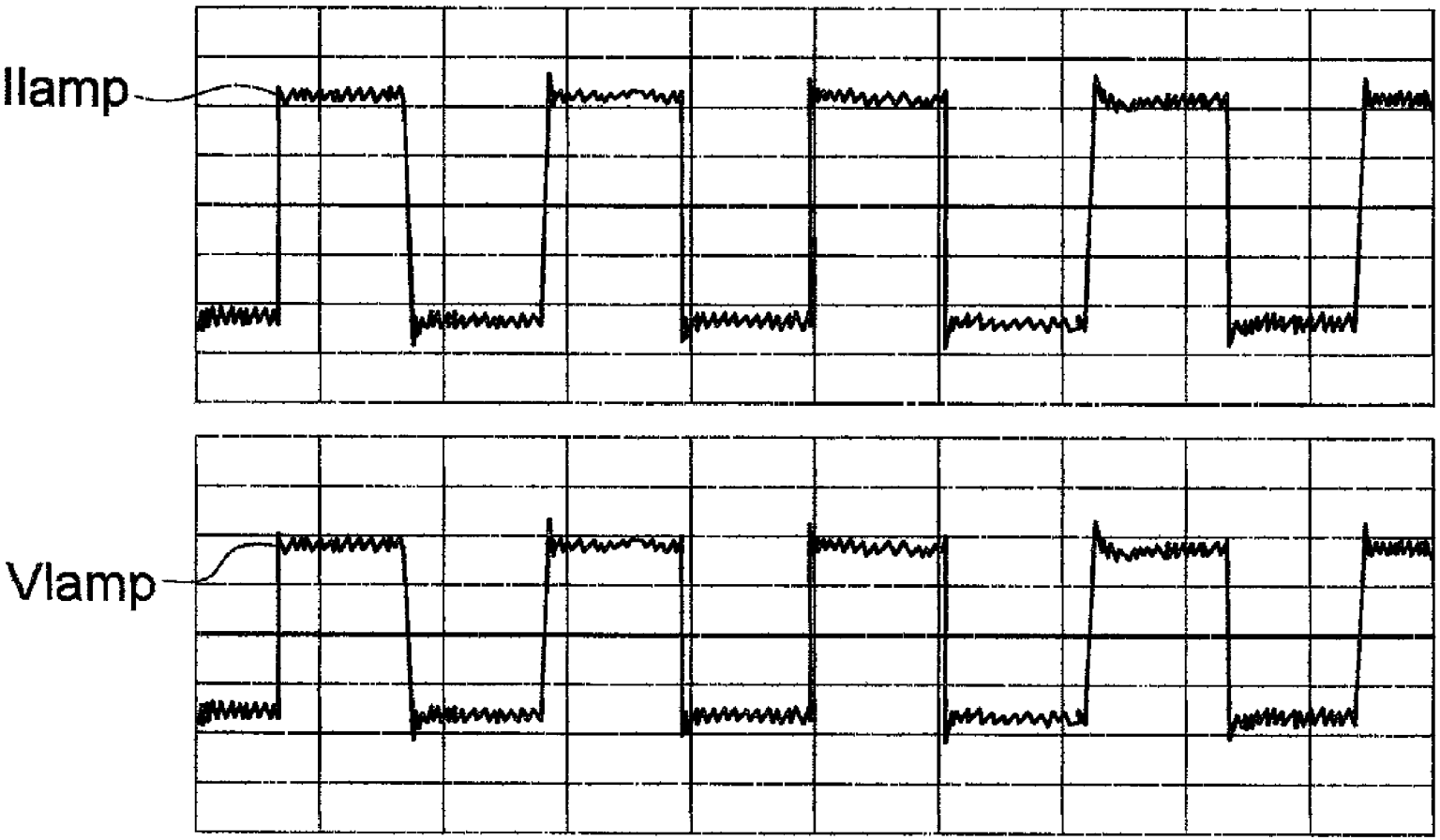

The current that flows inside the lamp is preferably controlled by means of a device 30 that detects the current by means of the sensing resistor Ri and detects the voltage Vout of the center-tapped secondary winding 12 across the sensing resistor Rv. The two detected signals are processed in order to construct the error signal, which enables the voltage and current across the lamp to be regulated from the time of ignition until the steady state operating condition is reached. In particular, the control function initially assures a square wave voltage of +/−280V across the lamp (nearly four times the steady state value) with a frequency of around 200 HZ; the lamp 20 in turn also receives voltage peaks of 2.5-3 KV from the igniter circuit 4. Once ignition has occurred, the lamp voltage rapidly drops to very low values (40% of the steady state value, i.e., approximately 110 V) and then the current control function takes over, which allows the power to be initially adjusted to 60% of the rated power and then to reach, in just over a minute of lamp warm-up, the steady state condition. The graphs in FIGS. 4 and 5 show the time diagrams of the voltage across the lamp Vlamp and the lamp current Ilamp during the ignition (FIG. 4) and after the ignition (FIG. 5) with the lamp in the steady state condition 20.

The device 30 allows the detected lamp voltage Vlamp and the detected lamp current Ilamp to be summed together and maintained constant. Considering the same value X for Vlamp and Ilamp and letting SUM indicate the output value of the device 30, it follows that SUM=X+X=K, where K is a constant. The maximum possible variation in either of the two would be 10%, i.e., SUM=(X+10% X)+(X−10% X)=K, so that, correspondingly, the power PLAMP=(X+0.1X)×(X−0.1X)=$X^2$−0.01 $X^2$=$P_{LAMPtyp}$−1%. Therefore 10% variations in $V_{LAMP}$ are controlled with a 1% variation in $P_{LAMP}$. The device 30 transmits the SUM signal to the input of a controller device 102; within the device 102, the SUM signal is compared, preferably by means of a comparator (non visible in the figures), with a constant reference signal K in order to produce the error signal Se. The device 102 is used to drive the transistor 101 of the flyback converter based on the error signal Se obtained. Preferably, the device 102 is a PFC controller, for example the STMicroelectronics device L6562D, to whose input INV the SUM signal is transmitted.

The transistor 101 of the flyback converter is preferably driven by the controller device 102 for the PFC stage, for example the STMicroelectronics device L6562D, in which a constant current is input to the MULT input of the multiplier in place of the traditional current envelope of the sinusoidal type. The controller device 102 is used as the controller for the PFC stage 28, in particular for controlling the power transistor of the boost converter.

Preferably, the ballast device includes a circuit 31 for recovering the leakage energy on the inductance of the transformer 10; and the circuit 31 includes the capacitor C3 and the diodes D2 and D4 coupled with the primary winding 11 of the transformer 10 in such a way as to obtain a recirculation of the current leaked from the transformer in the same primary winding of the transformer when the transistor 101 is turned off.

Preferably, the ballast has a protection circuit 40 in absence of a load for no-load protection. The circuit includes a capacitance C4 having one terminal connected to ground GND and another terminal connected to a Zener diode D21; the voltage present across the capacitor C4 is proportional to the voltage present across the secondary winding 12. When the voltage across the capacitance C4 exceeds the threshold voltage of the Zener diode D21, a pulse is transmitted in order to turn off the driving device of the lamp 20 by means of the control device 102, which turns off the transistor 101.

Preferably, the ballast includes a circuit 41 for setting the period of time in which the ignition pulse delivered by the igniter device 4 must be transmitted.

The various embodiments described above can be combined to provide further embodiments. All of the U.S. patents, U.S. patent application publications, U.S. patent applications, foreign patents, foreign patent applications and non-patent publications referred to in this specification and/or listed in the Application Data Sheet are incorporated herein by reference, in their entirety. Aspects of the embodiments can be modified, if necessary to employ concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is;

1. A driving device, comprising:

a first circuit adapted to convert an input network voltage to an output direct voltage, the first circuit including a transformer that includes a primary winding , a secondary winding having a center tap between two end terminals, a transistor, and at least two capacitive elements coupled to the center tap of the secondary winding of the transformer and to the end terminals of the secondary winding;

a second circuit configured to receive the output direct voltage and to convert the output direct voltage to an alternating signal; and a protection circuit configured to receive the output direct voltage and including a capacitor and a Zener diode, the capacitor having a first terminal coupled to a reference potential and a second terminal coupled to the Zener diode, the protection circuit configured to send a signal to turn off the driving device response to a voltage across the capacitor of the protection circuit overcoming a threshold voltage of the Zener diode.

2. The device of claim 1, wherein the second circuit includes a transistor half-bridge having two transistors and a central terminal that is in common between the two transistors and coupled to the center tap of the secondary winding of the transformer.

3. The device of claim 1, wherein the first circuit includes a driving circuit coupled to the transistor, the transistor coupled to the primary winding of the transformer and configured to regulate current passing through the primary winding.

4. The device of claim 3, comprising a first detection circuit adapted to detect voltage on the secondary winding of the transformer and to output a voltage signal, a second detection circuit adapted to detect current passing through the secondary winding of the transformer and to output a current signal, and a control circuit configured to process a sum signal that is a sum of the current and voltage signals and to compare the sum signal with a constant signal, the driving circuit configured to drive the transistor of the first circuit as a function of the comparison of the sum signal and the constant signal.

5. The device of claim 3, comprising a circuit configured to recover leakage energy on the inductance of the transformer, the leakage energy recovery circuit including a capacitor and two diodes coupled to the primary winding of the transformer and configured to obtain a re-flux of leakage current in the primary winding of the transformer when the transistor of the first circuit is turned off.

6. The device of claim 3, wherein the first circuit comprises a flyback converter.

7. A circuit, comprising:

a first circuit having a transistor and an input configured to receive an input voltage and an output, the first circuit configured to generate on the output a filtered and rectified voltage;

a second circuit coupled to the first circuit and configured to receive the filtered and rectified voltage and to output an alternating voltage, the second circuit comprising a transformer having a primary winding and a secondary winding with a center tap is and configured to output an alternating signal, the second circuit further comprising a first capacitance and a second capacitance coupled respectively to first and second terminals of the secondary winding, the second circuit further including a circuit configured to recover leakage energy on an inductance of the transformer, the leakage energy recovery circuit including a capacitor and two diodes coupled to the primary winding of the transformer and configured to obtain a re-flux of leakage current in the primary winding of the transformer when the transistor of the first circuit is turned off; and a half-bridge circuit coupled to the first and second capacitances, respectively, and to the secondary winding and configured to receive the alternating signal, the half-bridge circuit further configured to generate a driving current with an alternating square-wave voltage.

8. The circuit of claim 7, comprising a control circuit coupled to the secondary winding and configured to detect voltage and a current of the alternating signal on the center tap of the secondary winding and to generate a detected voltage signal and a detected current signal and to generate a sum signal representing a sum of the detected current and voltage signals, the control circuit configured to generate a control signal to the second circuit to maintain the sum signal constant.

9. The circuit of claim 8, comprising a controller device coupled to the control circuit and adapted to compare the sum signal to a constant reference signal and to generate an error signal that is received at the second circuit.

10. The circuit of claim 7, comprising a protection circuit coupled to the second circuit and having a capacitor configured to receive the filtered and rectified voltage and connected with a Zener diode, the protection circuit configured to send a signal to turn off the driving current with the alternating square-wave voltage when the filtered and rectified voltage across the capacitor of the protection circuit overcomes a threshold voltage of the Zener diode.

11. The circuit of claim 7, further comprising an HID lamp coupled to the half-bridge circuit and configured to be driven by the driving current with the alternating square-wave voltage.

12. A driving device, comprising:

a first circuit adapted to convert an input network voltage to an output direct voltage, the first circuit including a transformer having a primary winding and a transistor, and a secondary winding having a center tap between two end terminals, and at least two capacitive elements coupled to the center tap of the secondary winding of the transformer and to the ends of the secondary winding;

a second circuit configured to receive the direct voltage and to convert the direct voltage to an alternating signal adapted to supply the lamp; and a protection circuit configured to receive the output direct voltage and having a capacitor and a Zener diode, the capacitor having a first terminal coupled to a reference potential and a second terminal coupled to the Zener diode, the protection circuit configured to send a signal to turn off the driving device when a voltage across the capacitor of the protection circuit overcomes a threshold voltage of the Zener diode; and a circuit configured to recover leakage energy on the inductance of the transformer, the leakage energy recovery circuit including a capacitor and two diodes coupled to the primary winding of the transformer and configured to obtain a re-flux of leakage current in the primary winding of the transformer when the transistor of the first circuit is turned off.

13. The device of claim 12, wherein the first circuit comprises a flyback converter.

14. The device of claim 12, wherein the first circuit includes the transistor and a driving circuit coupled to the transistor, the transistor coupled to the primary winding of the transformer and configured to regulate current passing through the primary winding.

15. The device of claim 14, comprising a first detection circuit adapted to detect voltage on the secondary winding of the transformer and to output a voltage signal, a second detection circuit adapted to detect current passing through the secondary winding of the transformer and to output a current signal, and a control circuit configured to process a sum signal that is a sum of the current and voltage signals and to compare the sum signal with a constant signal, the driving circuit configured to drive the transistor of the first circuit as a function of the comparison of the sum signal and the constant signal.

* * * * *